US005463951A

United States Patent [19]

Waizmann et al.

[11] Patent Number: 5,463,951

[45] Date of Patent: Nov. 7, 1995

[54] PRINTING MACHINE SPRAY DEVICE

[75] Inventors: Franz Waizmann, Gessertshausen; Jürgen Hillenbrand, Kirchheim; Manfred Langenmayr, Biburg, all of Germany

[73] Assignee: Baldwin-Gegenheimer GmbH, Augsburg, Germany

[21] Appl. No.: 184,222

[22] Filed: Jan. 19, 1994

[30] Foreign Application Priority Data

Jan. 20, 1993 [DE] Germany ..... 43 01 410.0

[51] Int. Cl.[6] ..... B41F 23/02

[52] U.S. Cl. ..... 101/423; 101/147; 101/425

[58] Field of Search ..... 101/423, 424, 101/424.1, 425, 147, 148; 134/122 R, 144, 145, 148, 151; 239/413, 416.1, 417.5, 429; 118/300, 308, 310, 313

[56] References Cited

U.S. PATENT DOCUMENTS

| | | | |
|---|---|---|---|
| 2,960,929 | 11/1960 | Erzinger . | |
| 3,545,381 | 12/1970 | Jorgensen . | |
| 3,873,364 | 3/1975 | Smith | 101/425 X |
| 3,983,813 | 10/1976 | Tani | 101/425 |
| 4,208,449 | 10/1946 | Russell | 101/147 |
| 4,756,765 | 7/1988 | Woodroffe . | |
| 4,920,994 | 5/1990 | Nachbar . | |
| 4,924,891 | 5/1990 | Soubrier et al. | 134/122 R X |
| 5,005,478 | 4/1991 | Goldberg et al. | 101/425 |
| 5,080,015 | 1/1992 | Hansson et al. | 101/424 X |
| 5,097,764 | 3/1992 | Waizmann | 101/425 |
| 5,156,861 | 10/1992 | Tsuchiya et al. | 134/144 X |

FOREIGN PATENT DOCUMENTS

| | | | |
|---|---|---|---|
| 0419289 | 9/1990 | European Pat. Off. . | |
| 947612 | 8/1956 | Germany . | |
| 1229547 | 12/1966 | Germany . | |
| 2949466 | 6/1981 | Germany . | |
| 3505449 | 2/1985 | Germany . | |
| 3600591 | 1/1986 | Germany . | |
| 3721940 | 7/1987 | Germany . | |
| 3723400 | 2/1989 | Germany . | |
| 4019915 | 6/1990 | Germany . | |
| 58-175660 | 10/1983 | Japan . | |
| 62-050144 | 3/1987 | Japan . | |
| 0004947 | 1/1988 | Japan | 101/425 |
| 8301400 | 10/1982 | WIPO . | |

OTHER PUBLICATIONS

Anon.; Elimination of Surface Debris in Laser Ablation of Polymers; *IBM Technical Disclosure Bulletin,* vol. 34, No. 4B, Sep. 1991, p. 233.

Hauser, Oscar G.; Plasma Air Knife Cleaner; *Xerox Disclosure Journal,* vol. 16, No. 6, Nov./Dec. 1991, 369.

Bigelow, Richard W.; Texturing of Organic Photoreceptor Surfaces by Laser Ablation to Assist Blade Cleaning; *Xerox Disclosure Journal,* vol. 16, No. 2, Mar./Apr. 1991, p. 141.

Ruzyllo, Jerzy; Issues in Dry Cleaning of Silicon Wafers; *Solid State Technology,* Mar. 1990, pp. 1–4.

Schade, Klaus; Suchanek, Gunnar; and Tiller, Hans–Jurgen; Plasmatechnik; *Velag Technik,* Berlin 1990, pp. 154/155.

*Primary Examiner*—Edgar S. Burr
*Assistant Examiner*—John S. Hilten
*Attorney, Agent, or Firm*—Ostrolenk, Faber, Gerb & Soffen

[57] ABSTRACT

A printing machine spray device for moistening surfaces of cylinders, rolls, rollers which are rotating around a transverse axis of the machine and/or for moistening the material being printed which is moving in the longitudinal direction of the machine. The liquid is sprayed by two sprayers onto the surface to be moistened while the two sprayers are being moved in respective opposite directions transversely over the surface. Each sprayer starts from a different respective longitudinal side of the machine. Controls determine the on-off delivery of spray, the speed of sprayer motion, the starting positions of each of the sprayers and may adjust these for machine parameters. Automatic dosing of a specific quantity during one spraying is provided. The input to a sprayer may be from one of selected sources.

24 Claims, 1 Drawing Sheet

FIG. 1
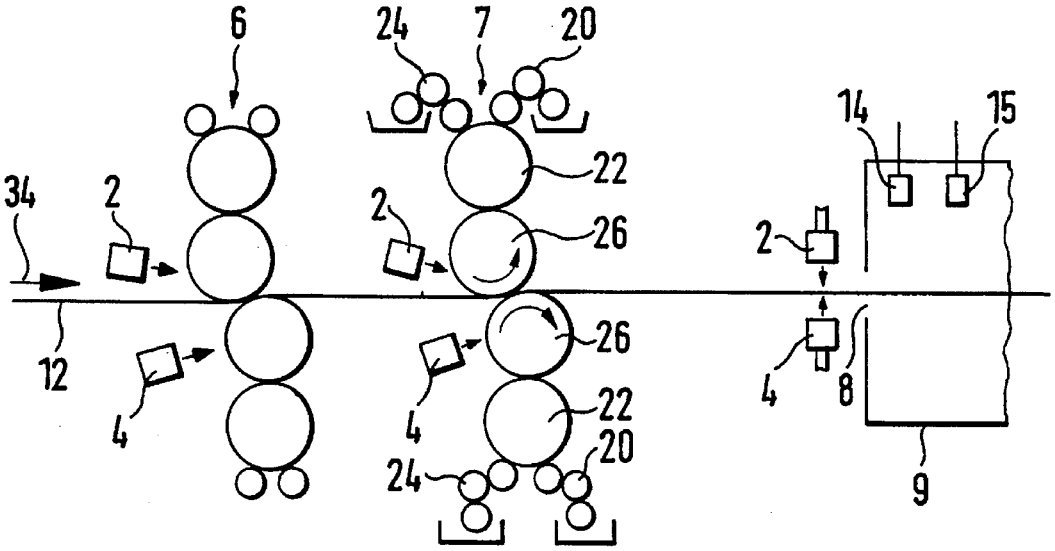
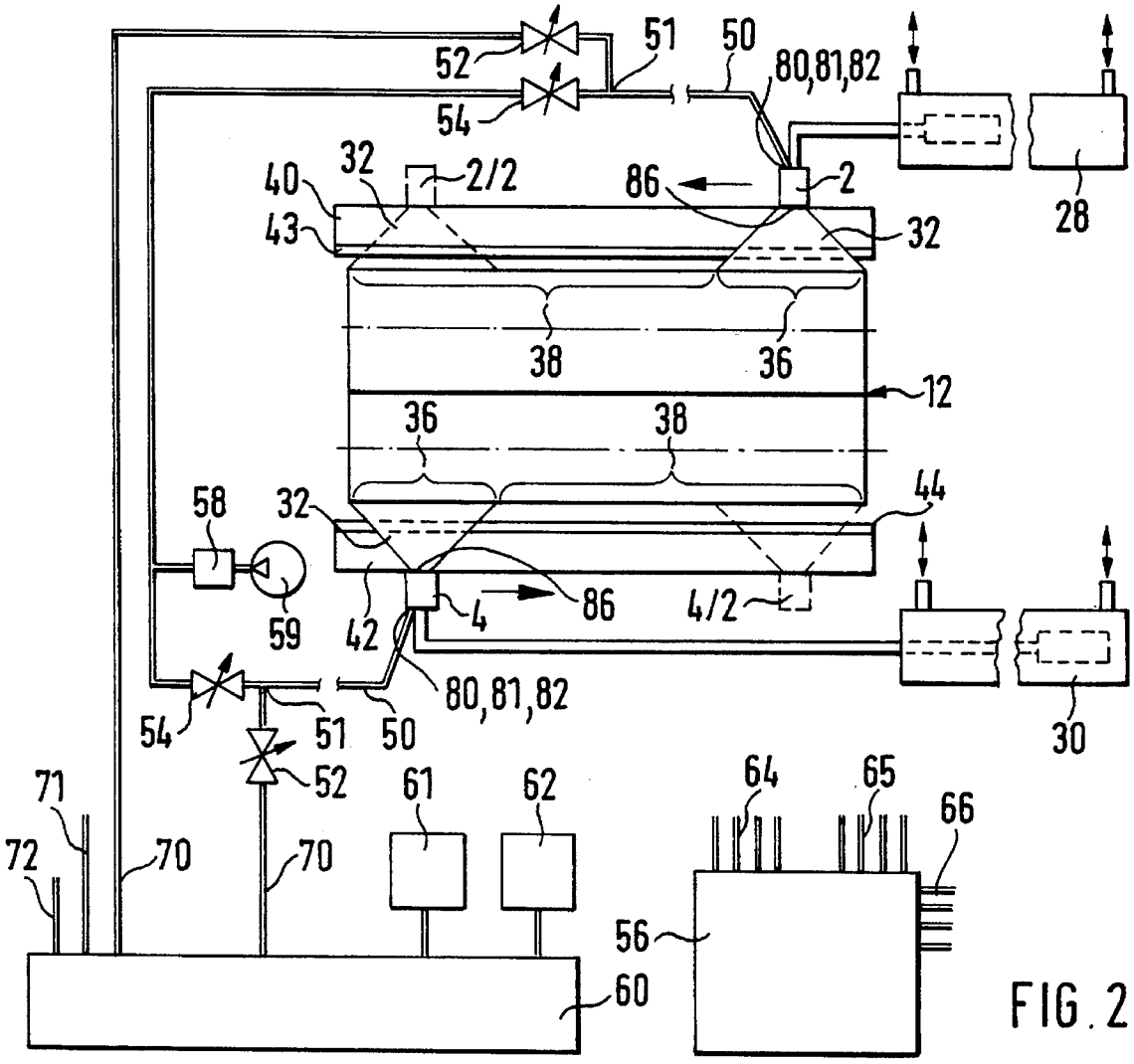
FIG. 2

PRINTING MACHINE SPRAY DEVICE

BACKGROUND OF THE INVENTION

The present invention relates to a spray device for printing machines which is used for spraying surfaces, such as a cylinder, roll, inking roll or the print material being printed, and particularly relates to control over movement of the sprayers.

A printing machine spray device according to the invention is a cleaning device for applying water, solvent or a detergent liquid onto inking rolls, printing plate cylinders, or rubber blanket cylinders of printing units of a printing machine, and particularly a web-fed offset printing machine. The invention is suitable for also applying other liquids, for instance damping water onto printing-plate cylinders, rubber blanket cylinders, damping rolls and inking rolls and, in general, is useful for uniformly distributing very small amounts of liquid over a relatively large surface, for instance on the material which is being printed in the printing unit. In the latter case, the liquid provides dosed moistening of the material being printed.

In each printing unit, two rubber blanket cylinders form a press nip through which the web or sheet material being printed is passed and that material receives the printing from the rubber blanket cylinders. Water or detergent liquid is sprayed onto the rubber blanket cylinder at the entrance side of the printing nip and is squeezed into the print material in the nip. The water or detergent liquid dissolves printing ink, residues of paper, and other dirt from the rubber blanket cylinders and transfers them to the print material being printed which then carries the undesired material away.

Instead of transmitting the dissolved dirt of the rubber blanket cylinders to the print material, a wash cloth can also be provided which is applied to the rubber blanket cylinders during the washing process and scrapes off the dissolved dirt. Printing machine cleaning devices having a wash cloth for the washing of rubber blanket cylinders are known, for instance, from EP 0 299 203 A2 and WO 89/81412.

Furthermore, the printing machine cleaning device of the present invention can be used for precisely dosed moistening of the print material after the printing and before the material travels into a dryer, or for moisturizing, prior to the printing, before the print material enters the printing unit. A spray device for spraying the printed material before it travels into a dryer is known from EP 0 299 203 A2. This is designed to avoid sudden evaporation of the volatile components of printing ink and detergent or solvent, to avoid the danger of explosion in the dryer, and to distribute the vaporization of the volatile components over the entire time of passage through the dryer.

Further prior art includes U.S. Pat. Nos. 1,042,012; 2,264,521; 3,545,381, Federal Republic of Germany Patents 12 29 547; 34 46 608 A1; DE 37 23 400 C1; DE 39 00 657 C1 and Patent Abstracts of Japan M-946, Mar. 7, 1980, Vol 14/No. 121 relating to JP 1-31/772.

SUMMARY OF THE INVENTION

The object of the invention is to create a printing machine spray device which enables even very small amounts of water to be distributed uniformly over a large surface. The spray device which, for instance, is a cleaning device, is capable of being controlled fully automatically as a function of operating parameters and operating conditions of the printing unit and of the entire printing machine. Furthermore, in the event of a reduction of the amount of liquid to a minimum value, the tearing of the print material at its edges due to excessive moisture or to dryness or to the material sticking to cylinders of the printing machine is to be avoided. At the same time, the printing machine spray device of the invention is to be of simple construction and require little maintenance.

The invention concerns a printing-machine spray device for moistening surfaces of cylinders, rolls, or rollers which are rotating around a transverse axis of the machine and/or the material being printed which is moving in the longitudinal direction of the machine. The liquid is sprayed by two sprayers onto the surface to be moistened while the two sprayers are being moved in respective opposite directions over said surface. Each sprayer starts from a different respective longitudinal side of the machine. Controls determine the on-off delivery of spray, the speed of sprayer motion, the starting positions of each of the sprayers and may adjust these for machine parameters. Automatic dosing of a specific quantity during one spraying is provided. The input to a sprayer may be from one of selected sources.

Other features and advantages of the present invention will become apparent from the following description of the invention which refers to the accompanying drawings.

BRIEF DESCRIPTION OF THE DRAWINGS

FIG. 1 is a schematic side view of a printing machine with printing units, a dryer and spray devices according to the invention; and FIG. 2 is a schematic view of the printing machine spray device in one of the printing units of FIG. 1, seen in the longitudinal direction of the machine.

DESCRIPTION OF A PREFERRED EMBODIMENT

The printing machine spray device of the invention shown in FIG. 1 contains two liquid sprayers 2 and 4 each having the form of at least one nozzle 2 and 4. Two sprayers 2 and 4 are respectively located in each printing unit 6 and 7 and are also directly in front of the entrance 8 to a dryer 9. The nozzles 2 are arranged above the print material 12 passing through the entire printing machine and the nozzles 4 are arranged below that material. The material is printed in the printing units 7 and then dried in the dryer 9. The volatile components, in particular water and solvent, in the printing inks evaporate in the dryer 9 and the dirtied cylinders of the printing units 6, 7 are periodically cleaned by detergent liquid.

The two nozzles 2 and 4 in front of the entrance 8 to the dryer 9 are directed from both above and below against the printed material 12 and they spray water onto the printed material. The water prevents the sudden volatilization of the volatile components directly downstream of the entrance 8 into the dryer 9 and it causes the vaporization of the volatile components to be distributed over the entire time of passage of the printing material 12 through the dryer 9. This avoids the formation of high concentrations of explosive vapors in the dryer downstream of the entrance 8.

There are sensors 14 and 15 within the dryer 9. One sensor 14 monitors the temperature and the other sensor 15 monitors the concentration of dangerous vapors and gases in the dryer 9. As a function of their measured values, the sensors 14 and 15, control the time and quantity of the application of the water by the nozzles 2 and 4 in front of the entrance 8 to the dryer 9. The sensors can also control the application of water and detergent liquid or printing ink in the printing units 6 and 7. Some other non-combustible and non-explosive liquid can also be used instead of water.

Since all of the sprayers 2 and 4 have the same design, and since they are automatically controlled in the same manner with respect to their position and the time and quantity of their delivery of water by the operating parameters and operating conditions of the printing machine, and particularly of the printing units 6, 7 and the dryer 9, only the sprayers 2 and 4 of the printing unit 7 are described in detail below. This description applies to the other sprayers 2 and 4.

The printing units 6 and 7, as is diagrammatically shown for the printing unit 7, have at each side of the print material 12, at least one inking unit 20 for applying printing ink to a plate cylinder 22, a moistening unit 24 for applying moistening liquid to the plate cylinder 22, and a printing cylinder 26, which is customarily a rubber blanket cylinder, for transferring the print from the plate cylinder 22 to the material 12 to be printed. The material 12 travels in S-shape through a nip between the two adjacent rubber blanket cylinders 26 above and below the print material 12.

FIG. 2 displays the printing machine spray device from the left side to the right side, as viewed in the longitudinal direction of the machine in FIG. 1. The sprayer or nozzle 2 of the printing unit 7 is arranged above the print material 12 and the nozzle 4 is arranged below the print material 12. The nozzles 2 and 4 are shown in FIG. 2 as swung upward and downward respectively by about 90°, as compared with their swing positions in FIG. 1, so that their details can be more easily noted.

The upper nozzle 2 can be moved and automatically controlled by an upper moving device 28. The lower nozzle 4 can be moved and automatically controlled by an identically developed lower moving device 30. The controlled movement is on a path transverse to the direction of longitudinal movement 34 of the print material 12 being conducted through the printing machine. The movement is over the entire transverse or width dimension, or over only a part of the width, of the print material 12 or of the rubber blanket cylinder 26, and in this connection the nozzles spray liquid 32 onto the corresponding rubber blanket cylinder 26. It is possible to move the nozzles 2 and 4 under continuous automatic control into any desired position along the width of the print material 12 or the width of the rubber blanket cylinders 26 and to spray liquid 32 onto the print material 12 or the rubber blanket cylinders 26 only when the nozzles are in their desired positions.

In FIG. 2, the sprayers or nozzles 2 and 4 spray liquid 32 onto the rubber blanket cylinder over a width which, corresponding to the path of transverse movement of the nozzles, is wider than the width 36 of the liquid spray cones 32 of these nozzles 2 and 4 on the rubber blanket cylinder 26. In the preferred embodiment, the path of transverse movement 38 of each nozzle is equal to the width of the rubber blanket cylinder 26, minus the width 36 of the spray cone 32 on the rubber blanket cylinder 26, as shown in FIG. 2. In this way, with a single transverse movement of the nozzle 2 or 4 over the path of transverse movement 38, the rubber blanket cylinder 26 is wetted over its entire width with liquid from the spray cone 32. During this movement, the nozzle 2 is moved from the right-hand position shown in solid line in FIG. 2 into the position 2/2 shown in dashed line to the left in FIG. 2. The nozzle 2 can then remain in the second position 2/2. If the rubber blanket cylinder 26 has to be moistened again later, the nozzle 2 is moved back from the left-hand position 2/2 into the right-hand position shown in solid line. Liquid is sprayed during this transverse movement onto the rubber blanket cylinder 26 in a manner corresponding to the spray cone 32.

In the embodiment shown, the lower nozzle 4 of the lower rubber blanket cylinder 26 is moved from left to right, opposite the movement direction of the upper nozzle 2. The lower nozzle 4 is in its right hand position 4/2 shown in dashed line when the upper nozzle 2 is in its left-hand position 2/2 shown in dashed line, and vice versa. This has the advantage that both side edges of the print material 12 are moistened immediately and simultaneously with liquid from the two nozzles 2 and 4, which liquid is transferred by the rubber blanket cylinder 26, so that sticking of the side edges of the print material to the rubber blanket cylinders 26 and resultant possible tearing of these side edges is avoided. During the process of washing by spraying liquid 32 from the nozzles 2 and 4 onto the rubber blanket cylinders 26, the feed of printing ink from the printing units 22 is normally shut off.

The nozzles 2 and 4 are developed to produce a respective spray cone 32 which is as wide as possible. The wider the spray cone 32, the shorter is the required path of transverse movement 38 of the nozzles. The nozzle or sprayer movement devices 28 and 30 may be pneumatic, hydraulic or electric drives for moving the nozzles 2 and 4.

The residues of printing ink, paper fibers, and other dirt dissolved or removed by the liquid of the nozzles 2 and 4 on the rubber blanket cylinders 26 are transferred in the nip between the two adjacent rubber blanket cylinders 26 to the print material 12 and are then carried away by the material.

Instead of transferring this dirt to the print material 12, a wash beam 40 or 42 can be arranged opposite each rubber blanket cylinder 26. The wash beam applies a wash cloth 43 or 44 against the facing rubber blanket cylinder 26. This scrapes from the rubber blanket cylinders the traces of ink and particles of dirt, which have been dissolved or removed by the liquid of the nozzles 2 and 4. Such wash beams, each having a wash cloth, are known from EP 0 299 203 A2.

The length of the path of transverse movement 38 depends on whether the nozzles 2 and 4 are to be moved over the entire width of the rubber blanket cylinder 26 or only over a part the width. This normally depends on the width of the print material 12 or over what portion of the width of the print material printing is to be effected, or on what widthwise position of the rubber blanket cylinder 26 the moistening in dot-shape, line-shape or surface-shape is to be effected with liquid from the nozzles 2 and/or 4. Although in each case several nozzles 2 and/or several nozzles 4 can be used, the embodiment shown in FIG. 2 is preferable, with only one nozzle 2 or 4 per rubber blanket cylinder 26. A small amount of liquid can be distributed more precisely in time and quantity and more uniformly onto a large surface with one nozzle than with several nozzles.

An automatic dosing device in each case dispenses a selected quantity of liquid which the nozzles 2 and 4 spray over their paths of transverse movement or in a given transverse position onto the associated rubber blanket cylinder 26 and, in the case of the nozzles 2 and 4 of the dryer 9, onto the print material 12. This automatic dosing device contains its own storage line 50 for each nozzle 2 and 4 for storing the respective dosed amount of liquid. The storage line 50 is connected at its downstream end to the corresponding nozzle 2 and 4 and is connected at its upstream end to two valves 52 and 54 via a branch 51. By opening of one valve 52 while the other valve 54 is kept closed, the storage line 50 is filled with liquid. The quantity of liquid is dependent on the feed pressure of the liquid and on the duration of the opening of the valve 52 and the volume capacity in the line 50. The two parameters of "time" and "feed pressure of the liquid" can either be fixed in advance or are preferably controlled automatically by an electronic control device 56 and are possibly adjusted as a function of further parameters of the printing machine. After the dosing of the liquid in the storage line 50, all valves 52 and 54 are again closed. In the event of a defect downstream of the valves, only at most the quantity of liquid contained in the storage line 50 can escape. For spraying the dosed amount of liquid, with one valve 52 closed, the other valve 54 is opened and the dosed amount of liquid is expelled by compressed air from the storage line 50 and the corresponding nozzle and is sprayed in the spray cone 32. The valves 52 for the liquid and the valves for the compressed air are timed by the electronic control device 56 such that the nozzles 2 and 4 can spray liquid only during the time that the nozzles 2 and 4 are to moisten the rubber blanket cylinder 26 or the print material 12, and the nozzles are moved for this transversely over these objects during the spraying process. The pressure of the compressed air and the flow resistances in the lines are so dimensioned that the dosed amount of liquid is distributed uniformly during the transverse movement of the nozzles 2 and 4 over their path of movement 36 and 38. The opening and closing of the valves 52 and 54 by the control device 56 takes place as a function of parameters and operating conditions of the printing machine. Such parameters are, for instance, pause times for the washing of the rubber blanket cylinders, the nature and quantity of the printing inks used, the width of the print material 12, and the like.

The compressed air valves 54 are in this case connected via a pressure regulator 58 to a source of compressed air 59. The liquid valves 52 are connected to a source of liquid 60. The liquid fed from the source of liquid 60 to the liquid valves 52 may be water, solvent, another wash liquid, or a composition containing several such components. The source of liquid 60 preferably contains means for optionally discharging water alone or for discharging any other wash liquid, or for mixing of water from a water reservoir 61 and a detergent from a detergent reservoir 62. This mixing and feeding of liquids to the source of liquid 60 can also be controlled and regulated in time and quantity by the control device 56. The control device 56 preferably contains several operating programs which carry out the control processes as a function of desired values.

The nozzles 2 and 4 of the one printing unit 6 and the nozzles 2 and 4 at the entrance 8 to the dryer 9 can also be connected in each case via a storage line 50 and liquid valves 52 and compressed air valves 54, which can be optionally opened, to the source of liquid 60 and the source of compressed air 59. The movement devices 28 and 30 of the nozzles 2 and 4 are also controlled by the control device 56. Thus, adaptation of the delivery of liquid to the transverse movement of the nozzles 2 and 4 and to the other parameters and operating situations of the printing machine is assured. In FIG. 2, connections 64 for the valves 52, connections 65 for the valves 54, and connections 66 for controlling the movement devices 28 and 29 are shown diagrammatically on the control device 56.

The conduits for the liquid at least in part comprise flexible hoses so that movements of the nozzles 2 and 4 relative to stationary parts are possible.

Each nozzle 2 or 4 moves within a very short time, preferably in less than one second, transverse to the longitudinal direction of the machine over the region of the rubber blanket cylinder 26 or of the print material 12 to be moistened. This is sufficient time to spray the dosed amount of liquid to be uniformly distributed over the entire path of transverse movement 36 and 38. An advantage of the invention is that, by the use of only very few and preferably only one nozzle for each surface to be moistened, even very small amounts of liquid can still be distributed uniformly over a large surface of the machine cylinder or the print material. The accuracy of the dosing is further improved if the liquid is dosed, in accordance with the above embodiment, in a storage line 50 and then only the dosed amount of liquid is sprayed in each case. This type of liquid dosing also has the advantage that, in the event of a defect of the machine, only the dosed amount of liquid can escape from the conduits, rather than a larger amount from the liquid reservoir. Another advantage of the invention is that the danger of liquid dripping onto the rubber blanket cylinders or the print material after completion of the spraying is reduced to the single nozzle 2 and 4. Due to the use of the storage line 50, followed by compressed air cleaning, the drip danger is almost completely avoided.

Instead of a nozzle 2 or 4, a liquid sprayer 2 or 4 having one or more nozzles or other liquid spray producers can in each case be used.

The liquid sprayed by the sprayers 2 and 4 onto the printing cylinders 26 is a cleaning liquid such as, for instance, water, solvent, detergent, or a mixture thereof. It cleans the printing cylinder 26.

Federal Republic of Germany DE 37 23 400 C1, discloses washing of a rubber blanket of a web fed offset printing machine in combination with a partial process concerning the heat set dryer. Solvent which has passed, as a result of the rolling movement of the rubber blanket cylinders in their printing position, is introduced by the web into the dryer. If there is a high concentration of ignitible vapors, there is an inherent danger of explosion. The production of solvent vapors is dependent upon the amount of solvent introduced, which corresponds to the amount of solvent used for the washing itself, upon the temperature, and upon further transport parameters of the traveling paper web. The production of such vapors is controlled by a material applied onto the surface of the web, which removes heat. The loading of the dryer with solvent vapors by the washing process, with the web traveling, which takes place in the printing unit is known.

One known problem in the case of rubber blanket washing with the web traveling is stretch tearing. Aside from the adhesive effects of the web, which are controlled upon continuous printing, atypical sudden contact forces can occur in the outlet slot of the rubber blanket cylinder. In the same way as in the case of variations in the tension of the web occurring upon the rubber blanket washing, this can lead to tearing of the web. On the other hand, there are processes in which wetting of the web with a parting liquid is superimposed on the critical phases during the washing of the rubber blanket. See Federal Republic of Germany 39 00 657 C1.

As compared with known applications, the object is to eliminate dirtying of the rolls and cylinders in particular through the use of the smallest possible amount of solvent with respect to the load of solvent in the printing room or in the dryer and, at the same time, to minimize the probability of the web tearing.

This object is achieved by the process features and the apparatus features of the device described here.

As compared with a spray arrangement having a plurality of nozzles in a nozzle beam which extends over the full width of the cylinder, the spraying from one nozzle or from a small number of nozzles, and preferably two, can be controlled better, since even disturbances which occur in large number can be more easily controlled by suitable measures. Maintenance and repair are simplified. A possibly larger expense in the case of a plurality of nozzles is reduced proportionally in case there are only one or two nozzles, so that the expense for adjustment is also financially reasonable. In the case of higher quality applications, the actual values with respect to the geometry of the jet and the amount of spray are recorded and act on actuators, which change the spray until the operation is again optimal.

It is advantageous to view the build-up of ink at the edges of the web of paper or sheets of paper in the printing direction separately from the remainder of the cleaning over the entire width and to direct amounts of spray locally and laterally on the edges, since places with a lower degree of dirtying by build-up of ink and paper dust do not require the same treatment.

It is also advantageous to locally attack critical places which reveal themselves, for instance by recurrent dirtied places on the printing plate, and to either omit or treat differently adjacent regions which show no dirt or less dirt.

The method and apparatus of the invention provide the flexibility for applying very small amounts of liquid with uniform distribution over large surfaces. These can be programmed on basis of fuzzy logic. Relatively extensive and fixed program portions for a moistening or washing program can be replaced with user friendly general instructions which nevertheless lead to complete success of the moistening.

In addition, the local application of liquid can be used to prevent the accumulation of dirt. In addition, the targeted partial use of liquid can be so dimensioned that no detectable spotting or blemishes results within the continuous printing process, while the preventive procedure results in longer stable continued printing. The program of such a partial cleaning is controlled either in accordance with a special aiming course or else the spraying is directed in a specific selected distribution only on the place at which there is a strong tendency toward dissolving or for frequency of cleaning.

The locally adjusted moistening is directed essentially at the edges of the print material, at selected regions corresponding to the ink bearing ink zones, and on surfaces or spots which are limited laterally and in the direction of printing. Upon lengthier action upon an axially located section or a partial width of the roll or cylinder, the moistening zone is also developed as strips. If the nozzle travels in this connection, the strip is not parallel to the direction of printing but, due to the lateral displacement, it extends at an angle to the direction of printing, for instance in the manner of an angled helical line.

In the event of brief action, the strip which is to be thought of as image of the moved surface on a limited surface as seen in the direction of development or a surface section which can be ideally represented as a rectangle.

Any surface moistening applied can advantageously be brought into agreement with the course of the printing. The build up of ink at the edges of the print material is in strip shape, so that it may be suitably counteracted by strip cleaning. Other ink zones tending toward the build up of ink and having a high ink coverage, which are produced by one ink or else by superimposed printing, may also be attacked in strip shape. Individual places of the print which are reproducible as surfaces with their specific coordinates are handled only in accordance with portions of the surface.

An entire cleaning over the width of the cylinder is covered by combining the treatment surfaces. The liquid sprayer is moved over the entire width of the cylinder in order to cover the entire outer surface of the roll or cylinder. Axial advance results in a helical or strip shaped coverage. Depending on the travel dynamics of the sprayer, the sprayer may also be moved rapidly laterally into the next position so that the cleaning pattern on the cylindrical outer surface of the printing unit cylinder is covered by individual rings arranged alongside of each other. In the case of surface action, the outer surface is conceived of as partial surfaces as in the case of a checkerboard. If the sprayer is moved axially, the fastest cleaning takes place with the greatest pitch of the helical line with which, after one revolution of the roll or cylinder, it is advanced by a width of action of the jet. Upon slower advance, the widths of action are superimposed repeatedly. As a result, a more intense action upon the cleaning is obtained, although with a longer time of cleaning. The pitch of the treatment strip is then flatter or smaller corresponding to a thread pitch.

For shortening the time required for the intended cleaning, the surface to be cleaned can be acted on only by one of two or more sprayers 2 and 4. A first sprayer 2 is preferably arranged on the left edge of the print material and a second sprayer 4 is arranged on the right edge. This arrangement has the advantage that its displacement can be arranged symmetric to the center of the print material. In the case of a web, asymmetric courses of the web tension are thereby counteracted.

Single side printing and perfecting in the case of a web fed machine lead to dirtying of both cylinders 26 which are opposite each other. In a double side printing unit, the sprayers 2, 4 are used from the starting position moving diagonally to the web, for instance the one sprayer 2 for the upper printing unit moving from the left and the other sprayer 4 for the lower printing unit moving from the right.

The liquid transferred to the print material again gives a symmetric pattern if the first printed side and the perfecting side are viewed together. This avoids the web, which absorbs only a limited amount of cleaning liquid, coming into contact with the cleaning liquid simultaneously from the top and from the bottom in one traverse region.

The strip shaped or surface action on the outer surfaces of rolls or cylinders to be cleaned has the decisive advantage in the case of a web fed printing machine that the amount of explosive solvent which travels with the web into the dryer can be kept low. The danger of explosion, which can be monitored by concentration detectors and temperature detectors, is considerably reduced.

One roll of the inking unit 20 may be a distributor roll which makes osciollating movements back and forth along its axis of rotation. During that oscillating movement, the distributor roll rubs along adjacent rolls of the inking unit 20 to distribute ink on their surfaces in the direction of their axes of rotation. The sprayers 2 and 4 may be directed to one or more of the rolls of the inking unit 20. The movement of the sprayers 2 and 4 which produce cleaning liquid tracks on the respective roll or rolls of the inking unit 20, which may be or may include the distributor roll, may be adapted to the oscillating movement of the distributor roll in such a way that the liquid of the cleaning tracks is being transferred by these rolls and the plate cylinder 20 to a pre-specified target on the rubber blanket cylinder 26.

The valve 52 of each sprayer 2 and 4 is arranged in the flow path between a feed line 70 and the storage line 50. Each sprayer 2 and 4 can have one or more spray nozzles. The spray nozzles can spray the same liquid or different liquids.

In accordance with a special embodiment, at least one of the nozzles 2 and/or 4 is provided with at least two liquid inlets 80, 81, 82 and a single nozzle outlet 86, which is associated with all the liquid inlets. In this way, different liquids can be sprayed in succession or simultaneously by the nozzle 2 and/or 4 from the source of liquid 60 or from the liquid reservoirs 61 and 62 over separate feed lines 70, 71, 72. Such nozzles are known as two component nozzles.

Instead of using cleaning liquid for the cleaning, another liquid, for instance water or a moistening liquid necessary in a printing machine for the printing process, can be used for moistening the corresponding surface.

With the invention, the total amount of liquid required can be divided over two sprayers 2 and 4. The two sprayers 2 and 4 start their liquid spraying process and the movement process which commences approximately at the same time, separately from each other at the opposite longitudinal edges of the print material 12. The sprayers 2 and 4 can be directed against the print material 12 and against one or more of the cylinders 22 and 26 and/or the rolls of the inking unit 20 and/or of the moistening unit 24, and spray the liquid thereon. In all cases, liquid arrives on both longitudinal edges of the print material simultaneously and uniformly, directly or indirectly, via the rolls or cylinders. In this way, the danger of the print material sticking to the rubber blanket cylinder 26 and/or tearing is considerably reduced.

The invention is suitable also for the wetting of guide rolls which conduct the print material 12 through the paper machine.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A spray device for a printing machine, wherein the printing machine has a moving surface to be sprayed by the spray device and wherein the moving surface is either a surface that moves in a longitudinal direction of the printing machine or that rotates around a transverse axis of the printing machine, and wherein the moving surface to be sprayed is a surface of a cylinder or a longitudinally moving printing material; the surface to be sprayed with liquid being arranged so as to extend in a transverse direction that is transverse to the longitudinal direction of the machine;

the spray device comprising:

a first and a second sprayer which do not move longitudinally with the printing material and which are directed so as to spray liquid on the moving surface, the first sprayer having a first start position at the start of the spray process, and the second sprayer having a second start position which is spaced in the transverse direction from the first start position;

respective first and second sprayer moving devices connected respectively with the first and second sprayers for moving the first and second sprayers in opposite transverse directions initially toward each other and then past and then away from each other, each of the first and second sprayer moving devices moving the respective sprayer in the traverse direction away from one machine side and toward an opposite machine side.

2. The spray device of claim 1, wherein the first and second start positions of the first and second sprayers are located approximately at longitudinal edges of the printing material so as to be spaced from each other in the transverse direction.

3. The spray device of claim 2, further comprising a controller operatively connected to the first and second sprayers for adjusting the start positions of the sprayers in the transverse direction.

4. The spray device of claim 1, further comprising a controller operatively connected to the first and second sprayers for adjusting the start positions of the sprayers in the transverse direction.

5. The spray device of claim 1, wherein each sprayer produces a respective spray pattern for being sprayed on the surface and the spray pattern of each sprayer is moved during transverse movement of the sprayer over the entire width of the surface that is to be moistened by spray.

6. The spray device of claim 5, further comprising means for causing each sprayer to spray liquid continually during its entire movement in the transverse direction.

7. The spray device of claim 5, wherein each sprayer produces a spray pattern that is generally cone-shaped.

8. The spray device of claim 4, further comprising an automatic dosing device for dosing a predetermined amount of spray liquid onto the moving surface through the sprayers during an entire range of transverse movement of the sprayers or at selected positions of the transverse movement of the sprayers.

9. The spray device of claim 1, further comprising an automatic dosing device for dosing a predetermined amount of spray liquid onto the moving surface through the sprayers during an entire range of transverse movement of the sprayers or at a selected positions of the transverse movement of the sprayers.

10. The spray device of claim 9, wherein the dosing device comprises a respective storage line communicating with each sprayer and sized for storing a respective dosed quantity of the liquid for each sprayer; the storage line having a downstream end connected to the respective sprayer and having an upstream end having a connector for connecting the respective storage line to a source of liquid for introducing a dosed quantity of liquid into the storage line.

11. The spray device of claim 10, wherein the storage line comprises a connector for connecting the storage line to a source of compressed air for expelling a dosed quantity of liquid out of the storage line and through the sprayer.

12. The spray device of claim 9, wherein the dosing device comprises a respective storage line communicating with each of the sprayers for storing a respective dosed quantity of the liquid for each sprayer, each storage line having a downstream end connected to the respective sprayer; each storage line having an upstream end having a connector for connecting the respective storage line to a source of compressed air for expelling a dosed quantity of liquid out of the storage line and through the sprayer.

13. The spray device of claim 1, wherein at least one of the sprayers is arranged above each of a pair of opposite sides of the printing material to be sprayed and is aimed to direct spray onto the surface to be sprayed from above the respective side of the printing material.

14. The spray device of claim 4, further comprising a signal generator for supplying control signals dependent upon parameters of the printing machine to the controller for enabling the controller to control the sprayers.

15. The spray device of claim 1, further comprising a control device connected with the sprayers for controlling the transverse movement of the sprayers and for controlling the spraying of the liquid therefrom; means for supplying control signals dependent upon parameters of the printing machine to the control device for enabling the control device to operate to control the sprayers.

16. The spray device of claim 1, further comprising a guide for guiding the sprayers to move in the transverse direction and substantially parallel to the transverse axis of rotation of the cylinder, the roll or the roller of the printing machine.

17. The printing machine of claim 13, wherein at least one of sprayers includes a multicomponent nozzle, including one nozzle outlet for liquid and including at least two liquid inlets, the inlets having connectors for connection to respective liquid supplies for supplying liquid to the one nozzle outlet.

18. The spray device of claim 1, wherein at least one of sprayers includes a multicomponent nozzle, including one nozzle outlet for liquid and including at least two liquid inlets, the inlets having connectors for connections to respective liquid supplies for supplying liquid to the one nozzle outlet.

19. A spray device for a printing machine, the printing machine having a moving surface to be sprayed by the spray device, the moving surface being either a surface that moves in a longitudinal direction of the printing machine or that rotates about a transverse axis of the printing machine, the moving surface to be sprayed being a surface of a cylinder or a longitudinally moving printing material; the surface to be sprayed with liquid arranged to extend in a transverse direction which is transverse to the longitudinal direction of the machine;

the spray device comprising:

a first and a second sprayer which are positioned so as to spray liquid on the moving surface, the first sprayer having a first start position at the start of the spray process and the second sprayer having a second start position which is spaced in the transverse direction from the first start position;

respective first and second sprayer moving devices connected respectively with the first and second sprayers for moving the first and second sprayers in opposite transverse directions initially toward each other and then past and then away from each other, each of the first and second sprayer moving devices moving the respective sprayer in the transverse direction away from one machine side and toward an opposite machine side so that each sprayer produces a general cone-shaped spray pattern and so that the spray pattern produced by each sprayer is moved during transverse movement of the sprayer over an entire width of the surface that is to be moistened by the spray pattern;

a controller operatively connected to the sprayers for adjusting the start positions of the sprayers in the transverse direction; and an automatic dosing device for dosing a predetermined amount of spray liquid onto the surface through the sprayers during an entire range of transverse movement of the sprayers or at selected positions of the transverse movement of the sprayers.

20. A printing machine comprising:

a moving surface moving in one of a longitudinal direction and a rotational direction about a transverse axis of the printing machine, the moving surface having a surface to be sprayed which extends in a transverse direction that is transverse to the longitudinal direction of the printing machine;

a first and a second sprayer positioned to spray liquid on the moving surface, the first sprayer having a first start position at the start of the spray process and the second sprayer having a second start position which is spaced in the transverse direction from the first start position;

respective first and second sprayer moving devices connected respectively with the first and second sprayers for moving the first and second sprayers in opposite transverse directions initially toward each other and then past and then away from each other, each of the first and second sprayer moving devices moving the respective sprayer in the transverse direction away from one machine side and toward an opposite machine side.

21. The printing machine of claim 20, further comprising a controller operatively connected to the first and second sprayers for adjusting the start position of the sprayers in the transverse direction.

22. The printing machine of claim 21, further comprising a signal generator for supplying control signals dependent upon parameters of the printing machine to the controller for enabling the controller to control the sprayers.

23. The printing machine of claim 20, further comprising a guide for guiding the sprayers to move in the transverse direction and substantially parallel to the transverse axis of rotation of the cylinder, the roll or the roller of the printing machine.

24. The printing machine of claim 20, wherein at least one of sprayers includes a multicomponent nozzle, including one nozzle outlet for liquid and including at least two liquid inlets having connectors for connection to respective liquid supplies for supplying liquid to the one nozzle outlet.

* * * * *